US011008852B2

(12) United States Patent
Brown

(10) Patent No.: US 11,008,852 B2
(45) Date of Patent: May 18, 2021

(54) SNUBBER TOOL FOR DOWNHOLE TOOL STRING

(71) Applicant: LORD Corporation, Cary, NC (US)

(72) Inventor: Michael R. Brown, Union City, PA (US)

(73) Assignee: Lord Corporation, Cary, NC (US)

( * ) Notice: Subject to any disclaimer, the term of this patent is extended or adjusted under 35 U.S.C. 154(b) by 0 days.

(21) Appl. No.: 16/466,514

(22) PCT Filed: Dec. 12, 2017

(86) PCT No.: PCT/US2017/065798
§ 371 (c)(1),
(2) Date: Jun. 4, 2019

(87) PCT Pub. No.: WO2018/111863
PCT Pub. Date: Jun. 21, 2018

(65) Prior Publication Data

US 2019/0338631 A1 Nov. 7, 2019

Related U.S. Application Data

(60) Provisional application No. 62/432,743, filed on Dec. 12, 2016.

(51) Int. Cl.
*E21B 47/024* (2006.01)
*E21B 47/017* (2012.01)
*E21B 17/07* (2006.01)

(52) U.S. Cl.
CPC ..... *E21B 47/024* (2013.01); *E21B 17/07* (2013.01); *E21B 47/017* (2020.05)

(58) Field of Classification Search
CPC .... E21B 47/024; E21B 47/017; E21B 47/013; E21B 47/175; E21B 17/07
See application file for complete search history.

(56) References Cited

U.S. PATENT DOCUMENTS

| | | | | |
|---|---|---|---|---|
| 4,094,360 | A | 6/1978 | Nelson | |
| 4,130,162 | A | 12/1978 | Nelson | |
| 4,186,569 | A * | 2/1980 | Aumann | E21B 17/07 175/321 |
| 4,265,305 | A | 5/1981 | Stone et al. | |
| 4,825,421 | A | 4/1989 | Jeter | |
| 5,073,877 | A | 12/1991 | Jeter | |
| 7,673,705 | B2 | 3/2010 | Gearhart et al. | |
| 2009/0014166 | A1 | 1/2009 | Cheeseborough | |
| 2011/0061934 | A1 | 3/2011 | Jekielek | |
| 2011/0186284 | A1 * | 8/2011 | Jekielek | E21B 47/017 166/65.1 |

(Continued)

FOREIGN PATENT DOCUMENTS

| | | |
|---|---|---|
| WO | 2015/112821 | 7/2015 |

*Primary Examiner* — Georges S Gray
(74) *Attorney, Agent, or Firm* — Lord Corporation

(57) ABSTRACT

A snubber tool can be installed in a downhole tool string to reduce vibration in the downhole tool string. The snubber tool includes two compliance components having different stiffness properties and pre-compression and a drive washer that selectively applies further compression to the compliance components in response to external forces acting on the snubber tool. The compliance components retain their initial pre-compression under external loading of the snubber tool.

20 Claims, 9 Drawing Sheets

(56) References Cited

U.S. PATENT DOCUMENTS

| | | | | |
|---|---|---|---|---|
| 2012/0247832 | A1 | 10/2012 | Cramer et al. | |
| 2013/0025886 | A1 | 1/2013 | Martinez et al. | |
| 2013/0140019 | A1 | 6/2013 | Pare et al. | |
| 2014/0374168 | A1* | 12/2014 | Michael | E21B 17/07 175/320 |

* cited by examiner

SNUBBER TOOL FOR DOWNHOLE TOOL STRING

CROSS-REFERENCE TO RELATED APPLICATIONS

This application claims the benefit of U.S. Provisional Patent Application 62/432,743, filed on Dec. 12, 2017, titled "SNUBBER TOOL FOR DOWNHOLE TOOL STRING", which is herein incorporated by reference.

BACKGROUND

Universal bottom hole orientation ("UBHO") subs are commonly used in directional drilling bottom hole assemblies (BHAs). A UBHO sub has a hollow cylindrical inner member called a "mule shoe" or "landing sleeve." A directional measurement tool, such as a measurement while drilling (MWD) tool or a logging while drilling (LWD) tool, may be contained within and locked to the mule shoe. The directional measurement tool may include electronics and/or other sensitive hardware. During drilling, the tool string will be subjected to substantial vibrations. To prevent damage to the sensitive components of the directional measurement tool, the sensitive components may be encased in vibration resistant housings. However, in some cases, the vibration resistant housings may not offer sufficient protection to the sensitive components. In some cases, it may be necessary to use an isolation system to protect the sensitive components from harmful vibrations, for example, vibrations over a certain frequency.

International Publication No. WO 2015/112821 (Cune et al.) describes an isolating mule shoe that may provide the functionality of a conventional mule shoe while protecting sensitive components from vibrations, such as vibrations having frequencies between 110 Hz and 200 Hz. The isolating mule shoe incorporates an isolator module with at least two axial displacement elements that are axially movable to shorten or lengthen the isolator in response to vibratory and/or shock input to the isolator.

SUMMARY

In some embodiments of the disclosure, a snubber tool for a downhole tool string includes a mule shoe adapter and a UBHO adapter for installing the snubber tool in the downhole tool string. The snubber tool further includes a rebound compliance component having a first stiffness and a first pre-compression and a compression compliance component having a second stiffness larger than the first stiffness and a second pre-compression smaller than the first pre-compression. The rebound compliance component and the compression compliance component are configured to retain at least of portion of the first pre-compression and second pre-compression, respectively, under external loading of the snubber tool. The snubber unit may further include a drive washer arranged between the rebound compliance component and the compression compliance component and coupled to the mule shoe adapter. The drive washer may be configured to selectively apply a further compression to the rebound and compression compliance components in response to a force acting on the mule shoe adapter.

In some embodiments of the disclosure, a downhole tool string includes a UBHO sub having a mule shoe disposed therein and a snubber tool as described above disposed within the UBHO sub. The mule shoe adapter of the snubber tool is coupled to the mule shoe, and the UBHO adapter of the snubber tool is mounted to the UBHO sub.

In other embodiments of the disclosure, a method of reducing vibration in a downhole tool string having a mule shoe includes installing a snubber tool as described above in the downhole tool string. The installation may include coupling the snubber tool to the mule shoe of the downhole tool string. The method includes receiving a force imparted on the mule shoe at the drive washer of the snubber tool and further compressing one of the rebound compliance component and the compression compliance component of the snubber tool in response to the received force by motion of the drive washer.

The foregoing general description and the following detailed description are exemplary of the invention and are intended to provide an overview or framework for understanding the nature of the invention as it is claimed. The accompanying drawings are included to provide further understanding of the invention and are incorporated in and constitute a part of this specification. The drawings illustrate various embodiments of the invention and together with the description serve to explain the principles and operation of the invention.

DETAILED DESCRIPTION

A snubber tool for a downhole tool string, such as a MWD tool string and the like, protects electronics and other sensitive equipment within the tool string from repetitive vibrations and/or shock vibrations. In some cases, the snubber tool has adapters that enable the snubber tool to be disposed within a UBHO sub and coupled to a mule shoe of the UBHO sub. The snubber tool is designed to mitigate shock transmitted up the tool string. According to some embodiments, the snubber tool may have a natural frequency of 80 Hz or higher and may be configured to isolate vibration sensitive components from vibration frequencies of 200 Hz or higher. In some embodiments, the snubber tool uses an elastomer section that is always in compression regardless of whether a net compressive loading or net tensile loading is applied to the snubber tool. This allows for longevity of the elastomeric components downhole and soft snubbing when the snubber tool is in overall compression or tension.

Figure 1A:
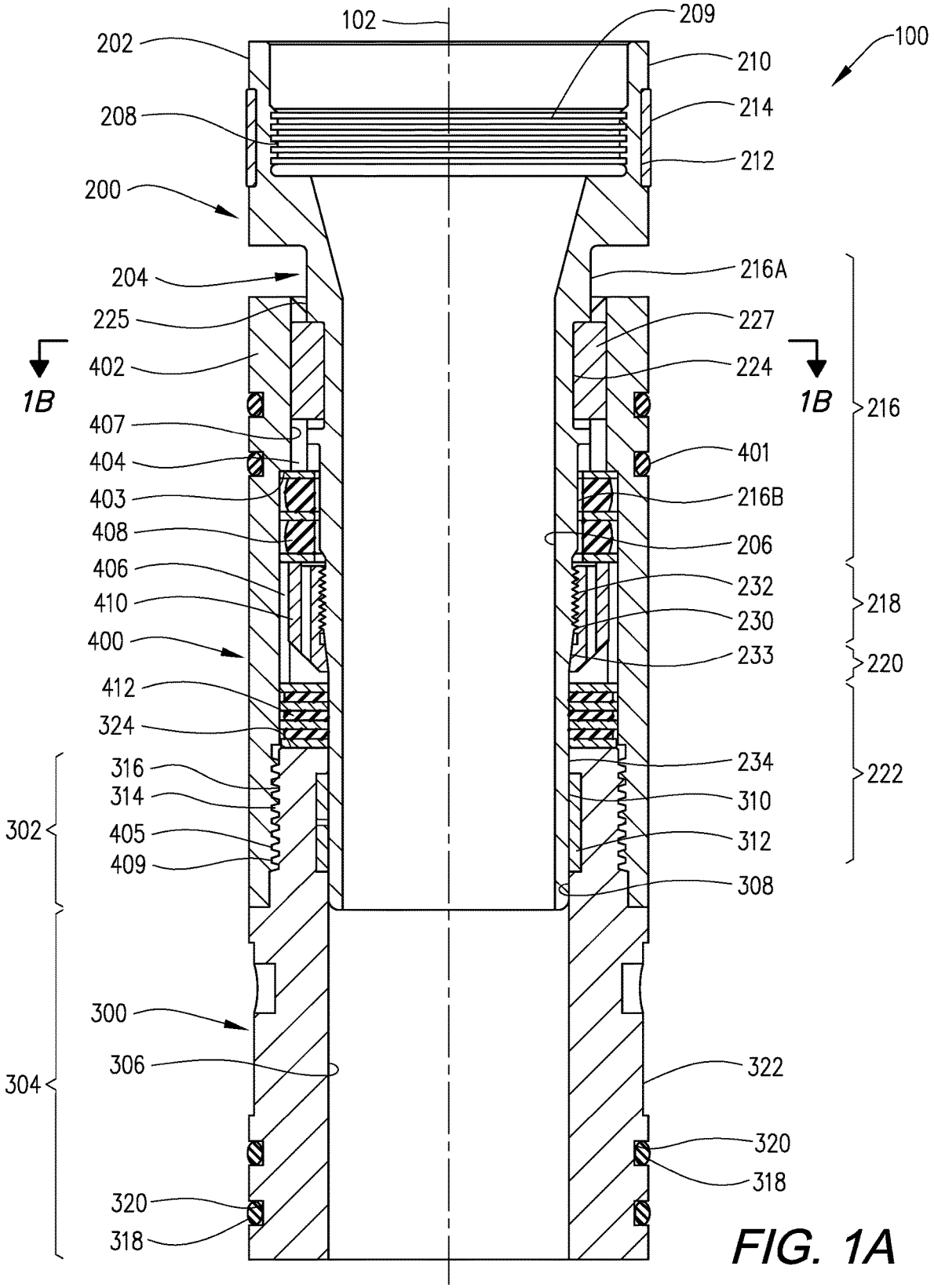
FIG. 1A is a cross-sectional view of a snubber tool for a downhole tool string in the assembled state.

FIG. 1A shows a cross-sectional view of a snubber tool 100 including a mule shoe adapter 200, a UBHO adapter 300, and a snubber unit 400. The snubber unit 400 includes a snubber housing 402, a rebound compliance component 408, a drive washer 410, and a compression compliance component 412. The snubber tool 100 may have an axial axis 102 along which the mule shoe adapter 200, the UBHO adapter 300, and the snubber unit 400 are generally axially aligned. In some embodiments, the mule shoe adapter 200 enables coupling of the snubber tool 100 to a conventional mule shoe/landing sleeve (not shown), and the UBHO adapter 300 enables installation of the snubber tool 100 within a conventional UBHO (not shown).

Figure 2:
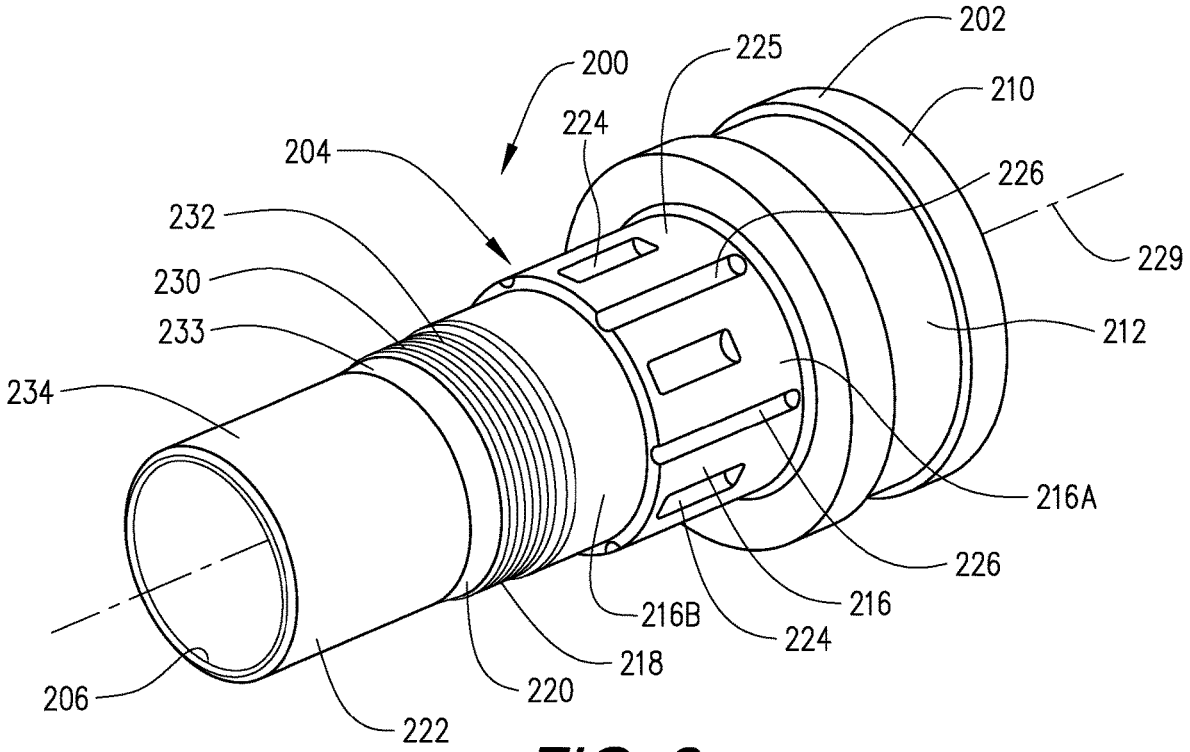
FIG. 2 is a schematic of a mule shoe adapter.

FIG. 2 shows a schematic of the mule shoe adapter 200. Referring to FIGS. 1A and 2, the mule shoe adapter 200 may have an adapter head 202 and an adapter body 204. The adapter body 204 is adapted for insertion into and coupling to the snubber unit 400, while the adapter head 202 is adapted for coupling to another tool member, such as, for example, a mule shoe/landing sleeve (not shown). The mule shoe adapter 200 has a central bore 206 that extends through the adapter head 202 and the adapter body 204. The inner surface 208 of the adapter head 202 may include threads 209 for forming a threaded connection with another tool member, such as, for example, a mule shoe/landing sleeve (not shown). The outer surface 210 of the adapter head 202 may include a circumferential recess 212. An external wear band 214 may be disposed in the circumferential recess 212. The external wear band 214 may provide lubrication and sliding support when the outer surface 210 mates with another surface (not shown) or acts as a bearing surface.

The adapter body 204 may include, in order, an upper body section 216, a threaded body section 218, a tapered body section 220, and a lower body section 222. The upper body section 216 may have a large diameter section 216A and a small diameter section 216B. Referring to FIG. 2, pockets 224 are formed in the outer surface 225 of the large diameter section 216A of the upper body section 216. In some examples, the pockets 224 may be distributed about a circumference of the large diameter section 216A and may be shaped to receive anti-rotation pins. FIG. 1A (also, FIG. 1B) shows anti-rotation pins 227 in the pockets 224. In some embodiments, the pockets 224 are longer (in the axial direction 102) than the anti-rotation pins 227 such that the anti-rotation pins 227 are permitted to move axially within the pockets 224. The anti-rotation pins 227 may be used to prevent rotation of the mule shoe adapter 200 relative to the snubber unit 400 while permitting axial motion of the mule shoe adapter 200 relative to the snubber unit 400. Other structures besides anti-rotation pins may be used for preventing rotation of the mule shoe adapter 200 relative to the snubber unit 400, such as multi-sided spline and convoluted spine. In such cases, a spline, rather than pockets for receiving anti-rotation pins, may be formed on the upper body section 216.

Returning to FIG. 2, grooves 226 are formed in the outer surface 225 of the large diameter section 216A of the upper body section 216. In some examples, the grooves 226 may be distributed about a circumference of the large diameter section 216A and may be in alternating arrangement with the pockets 224. In some examples, the grooves 226 are oriented generally parallel to an axial axis 229 of the mule shoe adapter 200. The grooves 226 provide flow paths, or pressure ports, on the upper body section 216 and may prevent or reduce wear or wash of the outer surface 225 of the upper body section 216, and any mating surface, due to high speed flow.

Returning to FIG. 1A, the threaded body section 218 has an outer surface 230 on which threads 232 are formed. The threads 232 may be used to form a threaded connection between the mule shoe adapter body 204 and the drive washer 410 of the snubber unit 400. The tapered body section 220, which is adjacent to the threaded body 218, has a tapered outer surface 233. The taper of the tapered outer surface 233 is in a direction from the threaded body section 218 to the lower body section 222, or the outer diameter of the tapered body section 220 decreases in a direction from the threaded body section 218 to the lower body section 222. In some embodiments, the taper angle of the tapered outer surface 233 may be about 6 degrees per side or about 12 degrees included.

Figure 3:
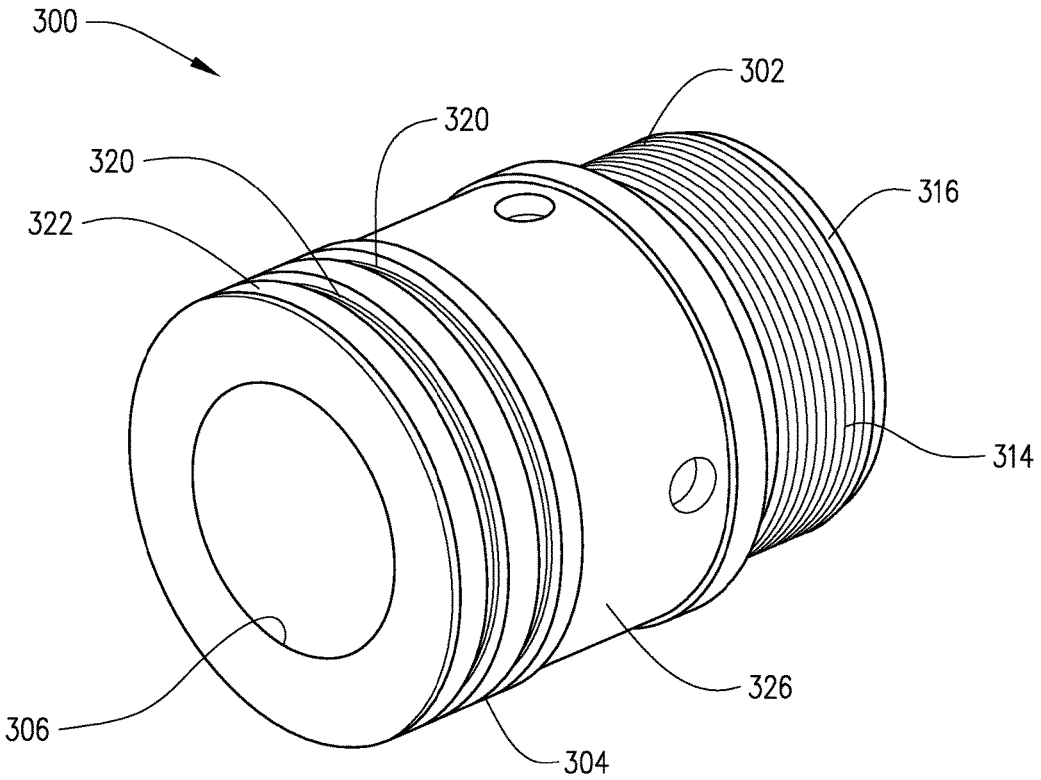
FIG. 3 is a schematic of a UBHO adapter.

FIG. 3 shows a schematic of the UBHO adapter 300. Referring to FIGS. 1A and 3, the UBHO adapter 300 has a small outer diameter section 302 and a large outer diameter section 304. The UBHO adapter 300 has a central bore 306 that extends through the small outer diameter section 302 and the large outer diameter section 304. The central bore 306 may be generally cylindrical in shape. In some examples, the inner diameter of the small outer diameter section 302 is selected such that the lower body section 222 of the mule shoe adapter body 204 can be received at least partially within the central bore 306. The inner diameter of the small outer diameter section 302 may be such that the inner surface 308 (in FIG. 1A) of the UBHO adapter small outer diameter section 302 mates with the outer surface 234 of the mule shoe adapter body section 204. In this mating position, the central bore 206 of the mule shoe adapter 200 and the central bore 306 of the UBHO adapter 300 align to form a central passageway through the snubber tool 100 for fluids and tools.

In some examples, the inner surface 308 of the UBHO small outer diameter section 302 may include a circumferential recess 310 in which a wear band 312 is mounted. The wear band 312 may provide lubrication between the mating mule shoe adapter surface 234 and UBHO adapter surface 308. The wear band 312 may further assist in aligning the mule shoe adapter 200 and the UBHO adapter 300 along the axial axis 102 of the snubber tool 100.

In some examples, threads 314 may be formed on the outer surface 316 of the small outer diameter section 302. The threads 314 may be used to form a threaded connection with the snubber housing 402 of the snubber unit 400.

In some examples, O-rings 318 may be provided in grooves 320 in the outer surface 322 of the large outer diameter section 304. The O-rings 318 may seal between the UBHO adapter 300 and another tool member, such as, for example, a UBHO sub.

Referring to FIG. 1A, the snubber housing 402 of the snubber unit 400 may be in the form of a sleeve. O-rings 401 may be provided in grooves in the outer surface of the housing 402. The O-rings 401 may seal between the snubber housing 402 and a mating surface of another tool member. For example, when the snubber tool 100 is disposed in a UBHO sub (not shown), the O-rings 401 may seal between the snubber housing 402 and a mating surface of the UBHO sub. The snubber housing 402 has an inner surface 407 defining a substantially cylindrical bore 404, which may be aligned along the axis 102. In some examples, threads 405 may be formed on a lower portion of the inner surface 407 of the snubber housing 402. FIG. 1A shows the upper body section 302 of the UBHO adapter 300 inserted into a lower portion of the bore 404. Also, a threaded connection 409 is formed between the inner threads 405 of the snubber housing 402 and the outer threads 314 of the UBHO adapter 300.

Figure 1B:
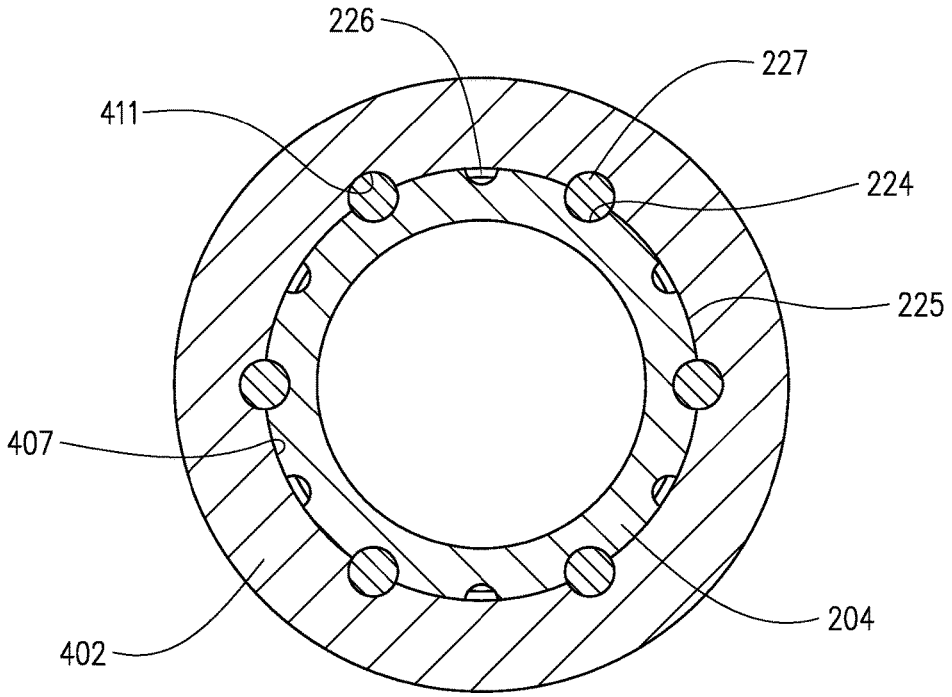
FIG. 1B is a cross-sectional view of FIG. 1A along line 1B-1B.

FIG. 1A further shows the mule shoe adapter body 204 occupying a central portion of the bore 404. In some embodiments, anti-rotation pins 227 are inserted between the mule shoe adapter body 204 and the snubber housing 402 to prevent rotation of the mule shoe adapter 200 relative to the snubber housing 402. Referring to FIG. 1B, grooves 411 are formed on the inner surface 407 of the snubber housing 402. The grooves 411 on the inner surface 407 of the snubber housing 402 correspond to the pockets 224 on the outer surface 225 of the mule shoe adapter body 204. Prior to inserting the mule shoe adapter body 204 into the snubber housing 402, the anti-rotation pins 227 are arranged in the pockets 224 on the outer surface 225 of the mule shoe adapter body 204. The sizes of the pockets 224 relative to the anti-rotation pins 227 are such that outer portions of the anti-rotation pins 227 protrude from their corresponding pockets 224. These protruding outer portions of the anti-rotation pins 227 slide into the corresponding grooves 411 when the mule shoe adapter body 204 is inserted into the snubber housing 402 and the grooves 411 are aligned with the pockets 224. With the anti-rotation pins 227 disposed between the pockets 224 and grooves 411, the mule shoe adapter 200 is permitted to move axially relative to the snubber housing 402 but prevented from rotating relative to the snubber housing 402.

Returning to FIG. 1A, the rebound compliance component 408, drive washer 410, and compression compliance component 412 of the snubber unit 400 are stacked in an annular space 406 between the mule shoe adapter body 204 and the snubber housing 402. Each of the rebound compliance component 408, drive washer 410, and compression compliance component 412 circumscribes a section of the mule shoe adapter body 204. In some examples, the drive washer 410 is mounted between, and is in contact with both, the rebound compliance component 408 and the compression compliance component 412 such that the drive washer 410 can apply axial compression to either of the components 408, 412 in response to an external force. In some embodiments, a shelf 403 is formed on the inner surface 407 of the snubber housing 402, and the rebound compliance component 408 is pre-compressed between the snubber housing shelf 403 and the drive washer 410. Also, the compression compliance component 412 is pre-compressed between the drive washer 410 and the UBHO adapter end face 324.

Figure 4A:
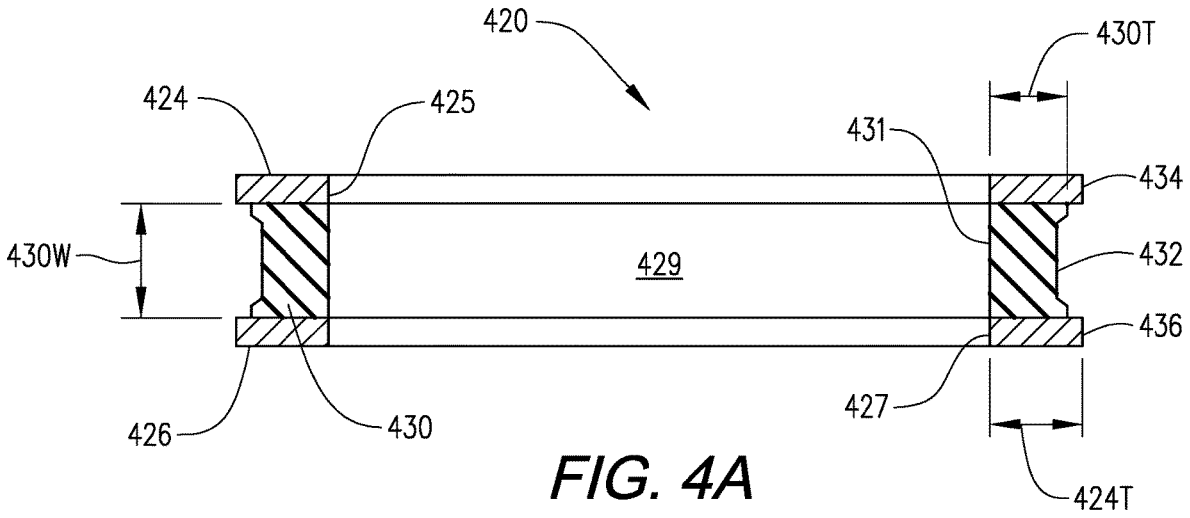
FIG. 4A is a cross-sectional view of a rebound compliance element.

The rebound compliance component 408 in FIG. 1A may include two or more rebound compliance elements. FIG. 4A shows a cross-section of an example rebound compliance element 420, which includes a parallel arrangement of shims (or spacer rings) 424, 426. An elastomer ring 430 is sandwiched between the shims 424, 426. The shims 424, 426 may be made of a metal, an alloy, or plastic. The elastomer ring 430 may be bonded to the shims 424, 426 to form a unitary structure. The inner surface 431 of the elastomer ring 430 and the inner surfaces 425, 427 of the shims 424, 426, respectively, may form a central opening 429. The central opening 429 allows the rebound compliance component 408 to be mounted about a section of the mule shoe adapter body (204 in FIG. 1A).

The elastomer ring 430 has an axial thickness 430W and a radial thickness 430T. In some examples, the radial thickness 430T may be selected to be smaller than the thickness 424T of the shim 424 (or shim 426) such that the outer circumferential surface of the elastomer ring 430 is recessed relative to the outer circumferential surfaces 434, 436 of the shims 424, 426, respectively. In some examples, the outer circumferential surface 432 of the elastomer ring 430 may have a contoured profile in the relaxed state. The contoured profile may be selected to lower induced strain in the elastomer ring 430 when the elastomer ring 430 is compressed. The contoured profile may be defined by a curved profile or a combination of curved and flat profiles. In some cases, the contoured profile may be such that the circumferential surface 432 has a generally concave shape in the relaxed state. In some examples, although not shown, the inner surface 431 of the elastomer ring 430 may also be contoured.

When the elastomer ring 430 is under bulk loading, the outer surface 432 and the inner surface 431 will bulge, i.e., radially expand. Where the surface is contoured, the contour profile may be determined by the desired shape factor when the elastomer ring 430 bulges, where shape factor may be determined by the ratio of load area to bulge area of the elastomer.

Figure 4B:
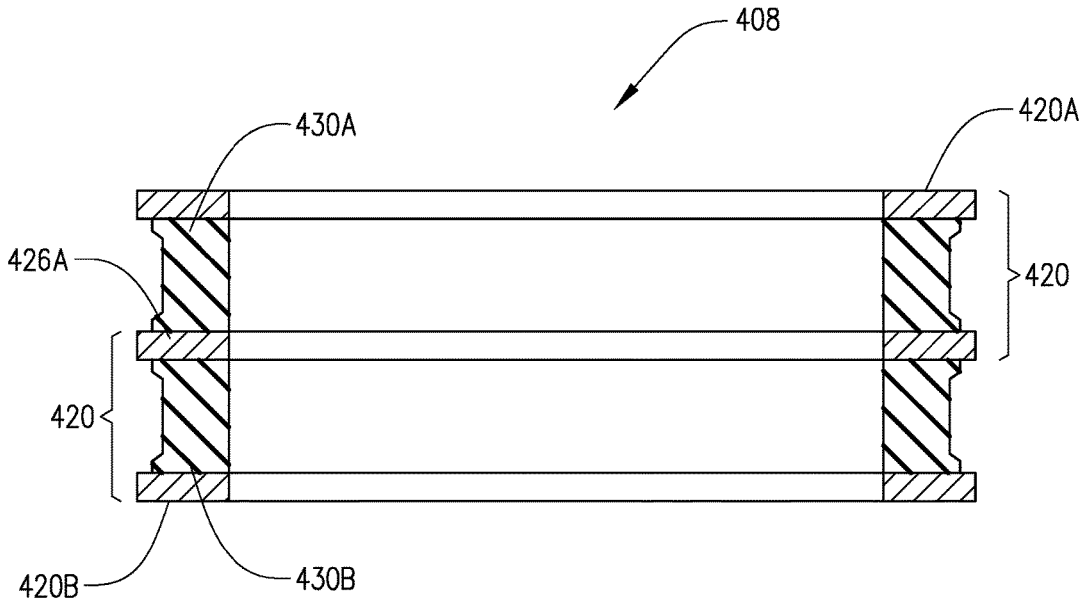
FIG. 4B is a cross-sectional view of a rebound compliance component including a stack of rebound compliance elements.

As previously mentioned, the rebound compliance component 408 may have two or more rebound compliance elements. FIG. 4B shows a cross-section of a rebound compliant component 408 including a stack of two compliance elements 420 (identified separately as 420A, 420B). In the stack, the bottom shim 426A of the upper compliance component 420A can double up as the top shim of the lower compliance component 420B. The bottom shim 426A will then act as a spacer between the adjacent elastomer rings 430A, 430B in the stack. Thus a rebound compliance component may generally be described as a structure comprising a stack of elastomer rings interleaved with non-elastomer shims, or a stack including an alternating arrangement of elastomer rings and non-elastomer shims, wherein the elastomer rings are configured to provide a predetermined contribution of the rebound compliance component to a desired axial stiffness of the compliant isolator. Typically, the elastomer rings in the stack will be identical, although it is possible to use different elastomer rings, for example, elastomer rings with different axial or radial thicknesses, in the stack.

To prevent metal-to-metal contact when the rebound compliant component 408 is installed about the mule shoe adapter body (204 in FIG. 1A) and the snubber tool (100 in FIG. 1A) is in the assembled state, the outer diameter of the elastomer rings 430A, 430B of the rebound compliant component 408 may be selected to be smaller than the inner diameter of the snubber housing (402 in FIG. 1A) such that there is a small gap between the elastomer rings of the rebound compliant component 408 and the snubber housing 402. Such a gap is shown, for example, at 433 in FIG. 6B. The gap, which may be called a snubbing gap, may have a minimum value of 0.01 inches in some cases.

Figure 5A:
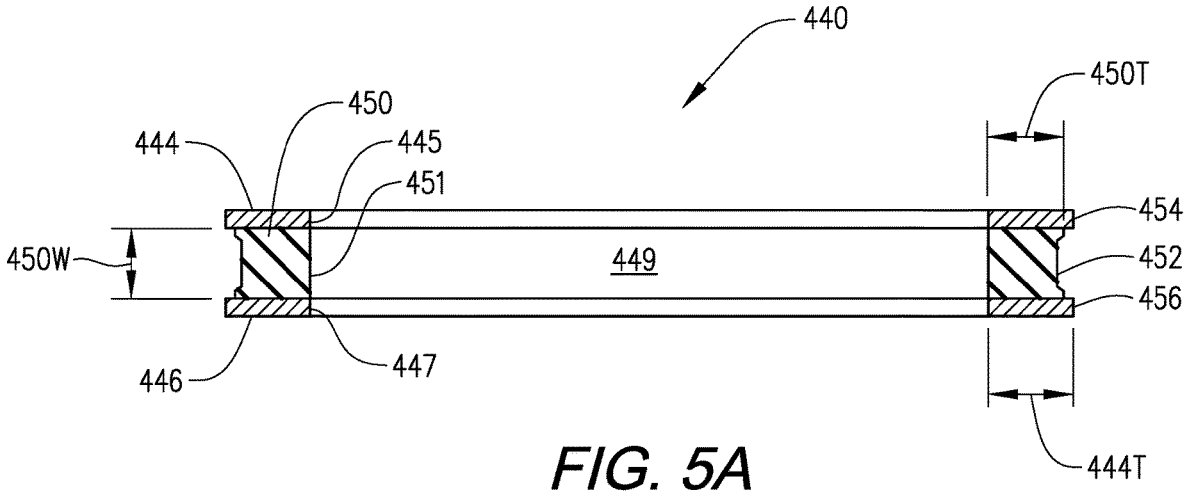
FIG. 5A is a cross-sectional view of a compression compliance element.

The compression compliance component (412 in FIG. 1A) may include two or more compression compliance elements. FIG. 5A shows a cross-sectional view of an example compression compliance element 440, which may have a structure that is similar to that of the rebound compliance element 420. The compression compliance element 440 may include a parallel arrangement of shims (or spacer rings) 444, 446. An elastomeric ring 450 is sandwiched between the shims 444, 446, which may be made of, for example, metal, an alloy, or plastic. The elastomer ring 450 may be bonded to the shims 444, 446 to form a unitary structure. The inner surface 451 of the elastomer ring 450 and the inner surfaces 445, 447 of the shims 444, 446, respectively, may form a central opening 449 that allows the compression compliant element to be installed on the lower body section of the mule shoe adapter body (204 in FIG. 1A).

The elastomer ring 450 has an axial thickness 450W and radial thickness 450T. As mentioned previously, the structure of the compression compliance component 440 may be similar to the structure of the rebound compliance component (420 in FIG. 4A). However, one notable difference between the compression compliance component 440 and the rebound compliance component (420 in FIG. 4A) is that the axial thickness 450W of the compression elastomer ring 450 is relatively smaller than the axial thickness (430W in FIG. 4A) of the rebound elastomer ring (430 in FIG. 4A). This generally means that the compression compliant element is relatively stiffer than the rebound compliance element, or that the rebound compliance element is relatively softer than the compression compliant element.

In some examples, the radial thickness 450T may be selected to be smaller than the thickness 444T of the shim 444 (or shim 446) such that the outer circumferential surface 452 of the elastomer ring 450 is recessed relative to the outer circumferential surfaces 454, 456 of the shims 444, 446, respectively. Typically, the recession amount would be determined by the expected bulging of the elastomer ring 450 under bulk loading. Under bulk loading, the elastomer ring 450 will fill up any available free volume between the elastomer ring and adjacent surfaces of the mule shoe adapter body (204 in FIG. 1A) and snubber housing (402 in FIG. 1A). In other examples, the radial thickness 450T may be substantially the same as the thickness 444T of the shim.

In some cases, the outer circumferential surface 452 of the elastomer ring 450 may have a contoured profile in the relaxed state, and the contoured profile may be selected to lower induced strain in the elastomer ring 450 when the elastomer ring 450 is compressed. The contoured profile may be defined by a curved profile or a combination of curved and flat profiles. In some cases, the contoured profile may be such that the circumferential surface 452 has a generally concave shape. When the elastomer ring 450 is compressed, the outer circumferential surface 452 will bulge or expand radially. The contoured profile of the outer circumferential surface 452 may be determined based on the desired shape factor when the elastomer ring 450 is compressed. Although not shown, the inner surface 451 of the elastomer ring may also be contoured in the manner described above for the outer surface 452.

Figure 5B:
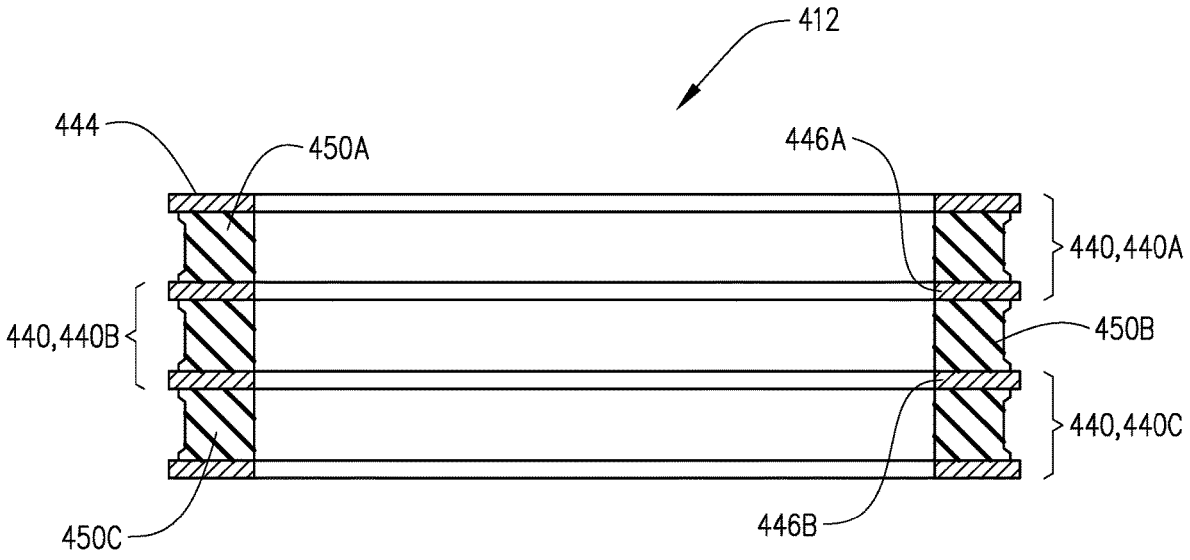
FIG. 5B is a cross-sectional view of a compression compliance component including a stack of compression compliance elements.

As previously mentioned, the compression compliance component (412 in FIG. 1A) may have two or more compression compliance elements. FIG. 5B shows one embodiment of the compression compliance component 412 including a stack of three compression compliance elements 440 (identified separately as 440A, 440B, 440C). In the stack, the bottom shim 446A of the upper compression compliance element 440A can double up as the top shim of the middle compression compliance element 440B, and the bottom shim 446B can double us as the top shim of the bottom compression compliance element 440C. The bottom shims 446A, 446B in this case are acting as spacers between the elastomer rings 450A, 450B and 450B, 450C, respectively, in the stack. Thus the compression compliance component may be generally described as a structure comprising a stack of elastomer rings interleaved with non-elastomer shims, or a stack including an alternating arrangement of elastomer rings and non-elastomer shims, wherein the elastomer rings are configured according to a predetermined contribution of the compression compliance component to a desired axial stiffness of the compliant isolator. Typically, the elastomer rings in the stack will be identical, although it is possible to use different elastomer rings in the stack, for example, elastomer rings with different axial and radial thicknesses.

To prevent metal-to-metal contact when the compression compliance component 412 is installed about the mule shoe adapter body (204 in FIG. 1A) and the snubber tool (100 in FIG. 1A) is in the assembled state, the outer diameter of the elastomer rings 450A, 450B, 450C of the compression compliance component 412 may be selected to be smaller than the inner diameter of the snubber housing (402 in FIG. 1A) such that there is a small gap between the elastomer rings of the compression compliance component 412 and the snubber housing 402. Such a gap is shown, for example, at 453 in FIG. 6B. The gap, which may be called a snubbing gap, may have a minimum value of 0.01 inches in some cases.

Returning to FIG. 1A, the structure of the rebound compliance component 408 may be similar to that of the compression compliance component 412, as described above. However, the rebound compliance component 408 may be distinguished from the compression compliance component 412 by its stiffness. In general, the rebound compliance component 408 will be relatively softer than the compression compliance component 412, or the compression compliance component 412 will be relatively stiffer than the rebound compliance component 408. This can be observed in the amount of pre-compression that each component can take during assembly of the snubber tool. In general, the rebound compliance component 408 will have a much higher pre-compression deflection than the compression compliance component 412. The rebound compliance component 408 may also be distinguished from the compression compliance component 412 by axial thickness of the elastomer rings. In general, the sum of the axial thicknesses of the elastomer rings in the rebound compliance component 408 will be larger than the sum of the axial thickness of the elastomer rings in the compression compliance component 412. The rebound compliance component 408 is configured to take rebound load. That is, when tension is applied to the snubber tool, the rebound compliance component 408 will go into further compression. On the other hand, the compression compliance component 410 is configured to take static load due to gravity and dynamic load when the snubber tool 100 is put into compression.

Figure 6A:
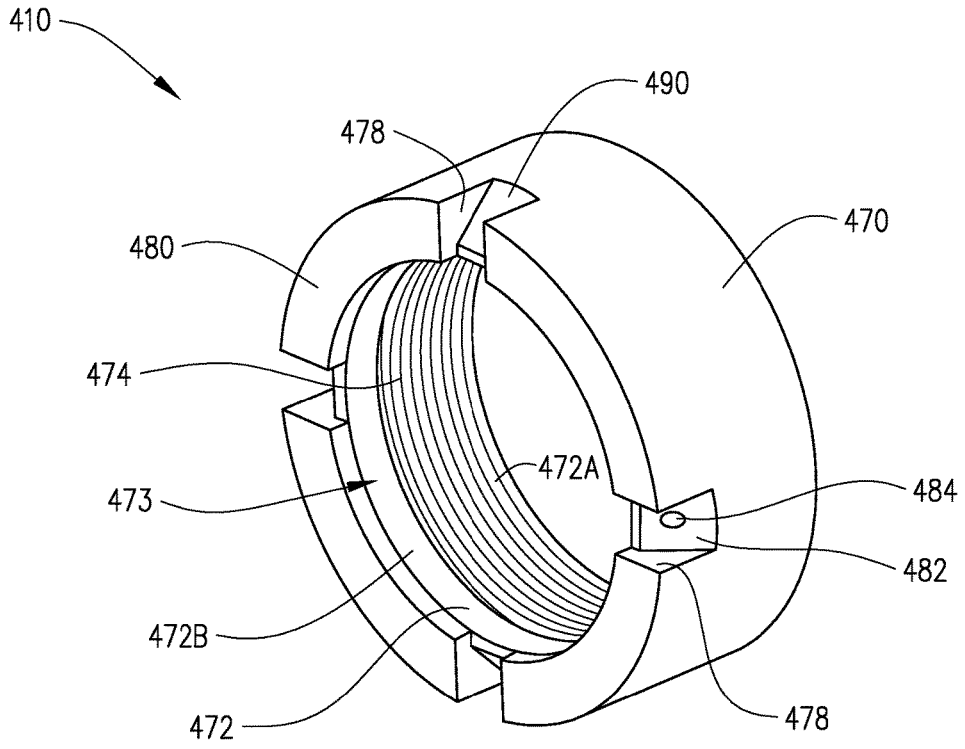
FIG. 6A is a schematic of a drive washer.
Figure 6B:
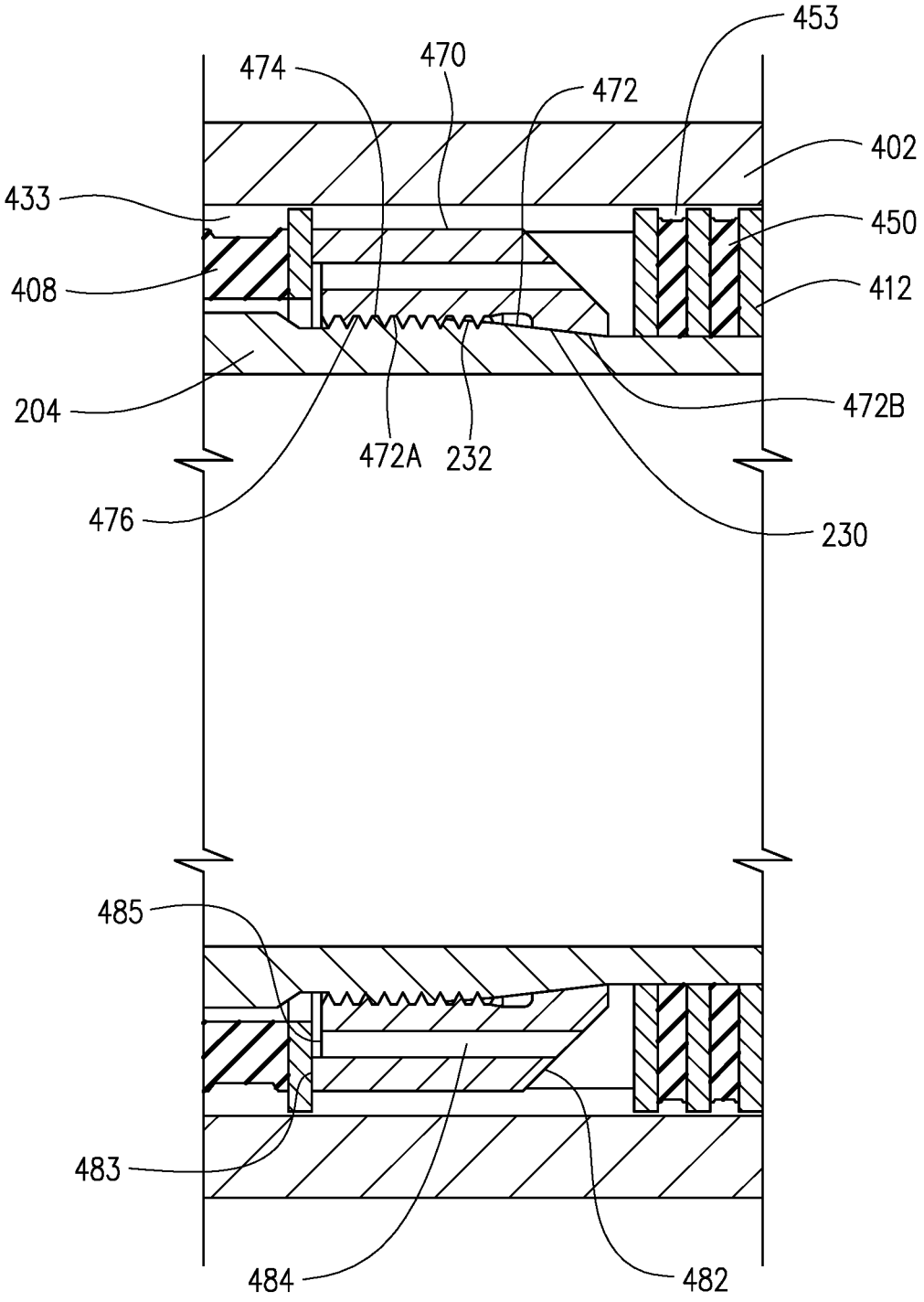
FIG. 6B is an enlarged section of the snubber tool of FIG. 1A prior to pre-compression and focusing on the region containing the drive washer.

FIG. 6A shows a schematic of the drive washer 410. FIG. 6B is an enlarged section of the snubber tool 100 shown in FIG. 1A, focusing on the region containing the drive washer 410. Referring to FIGS. 6A and 6B, the drive washer 410 includes a cylindrical body 470 an inner surface 472 defining a central opening 473. Threads 474 are formed on an upper portion 472A of the inner surface 472. The driver washer threads 474 engage with the mule shoe adapter threads 232 to form a threaded connection 476 (in FIG. 6B) between the driver washer 410 and the mule shoe adapter body 204. A lower portion 472B of the inner surface 472 is tapered. The taper angle of the tapered inner surface 472B is selected to match that of the tapered outer surface 233 of the mule shoe adapter body 204. The drive washer 410 is designed such that higher compression/shock loading will be reacted by the taper angle of the tapered inner surface 472B instead of acting solely on the threads 474. Tensile rebound loads will be reacted by the threads 474 only. The threads 474 will also carry fishing loads. In some cases, the threads 474 may carry fishing loads of 20,000 lbf to 75,000 lbf.

Referring to FIG. 6A, in some examples, slots 478 may be formed in an end portion 480 of the cylindrical body 470. The slots 478 may be distributed along the circumference of the cylindrical body 470. The slots 478 have bases 482, which may be sloping, as shown, or flat. The slots 478 may be used as spanner wrench slots for assembly and disassembly purposes. Through-holes 484 are formed in the wall of the cylindrical body 470. The holes 484 may extend from the bases 482 of the slots 478 to a counterbore 485 (in FIG. 6B) on an end face 483 (in FIG. 6B) of the cylindrical body 470. The holes 484 may act as pressure compensation ports. In some examples, the holes 484 allow fluid communication between the inner surfaces of the rebound compliance component 408 and the compression compliance component 412, i.e., the surfaces opposing the mule shoe adapter body 204. The holes 484 also allow fluid communication between the outer surfaces of the rebound compliance component 408 and the compression compliance component 412, i.e., the surfaces opposing the snubber housing 402.

Figure 7A:
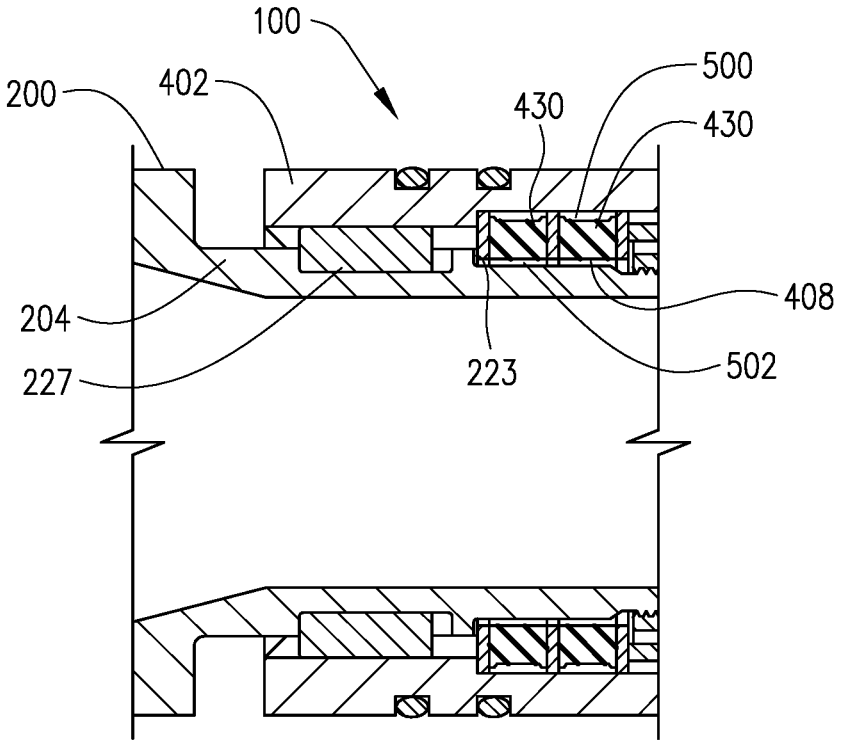
FIG. 7A is an enlarged section of the snubber tool of FIG. 1A prior to pre-compression and focusing on the region containing the rebound compliance component.
Figure 7B:
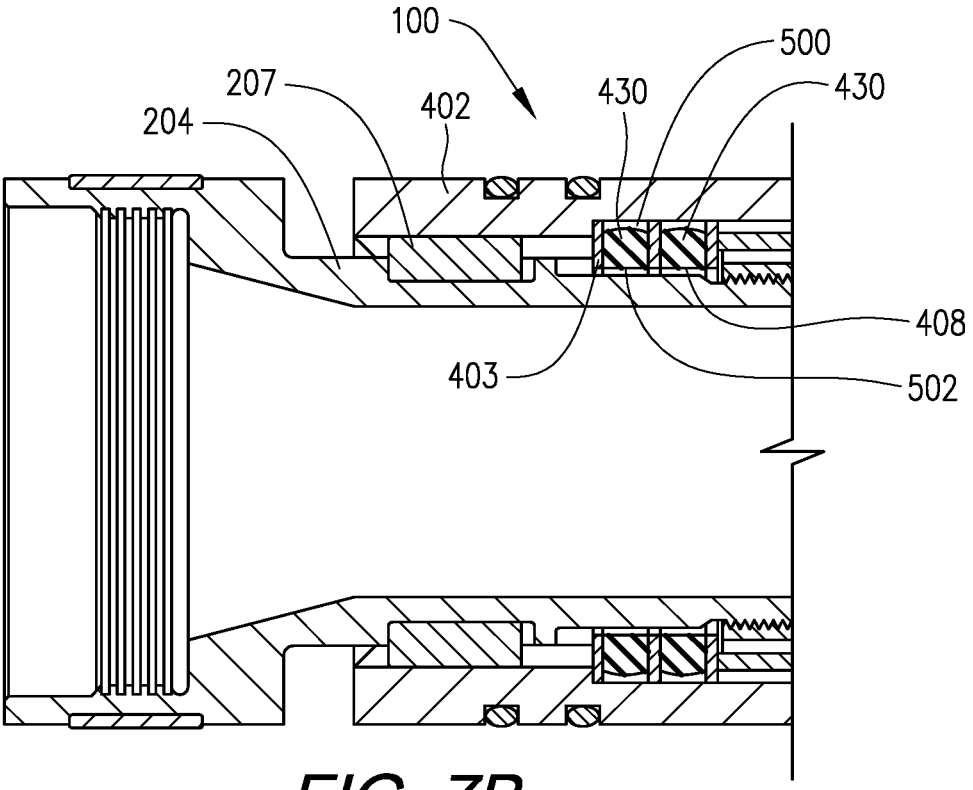
FIG. 7B is an enlarged section of the snubber tool of FIG. 1A in the assembled state and focusing on the region containing the rebound compliance component.

Returning to FIG. 1A, in the assembled state of the snubber tool 100, the snubber tool 100 is pre-compressed. That is, the rebound compliance component 408 and compression compliance component 412, or more specifically the elastomer rings of the compliance components 408, 412, are pre-compressed. Pre-compression may be achieved during assembly of the snubber tool. One method of pre-compression may include compressing the "snubbing stack" comprised of the rebound compliance component 408, drive washer 410, and compression compliance component 412 between the shelf 403 of the snubber housing 402 and the end face 324 of the UBHO adapter 300. The term "compressing the snubbing stack" is used because the initial length of the snubbing stack before pre-compression will be longer than the distance, measured in a direction along the axis 102, between the snubber housing shelf 403 and the UBHO adapter end face 324. Therefore, the pre-compression in the rebound compliance component 408 and compression compliance component 412 is achieved by shortening the length of the stack and constraining the stack between the shelf 403 and end face 324. It should be noted that the drive washer 410 is non-elastic such that the pre-compression goes into the compliance components 408, 412. The method of pre-compression may include installing the rebound compliance component 408, the drive washer 410, and the compression compliance component 412 on the mule shoe adapter body 204. The anti-rotation pins 227 may also be arranged in the pockets 224 on the mule shoe adapter body 204. Then, the mule shoe adapter body 204 is inserted into the snubber housing 402. This may include sliding the anti-rotation pins 227 into the grooves 411 in the snubber housing 402. Finally, the threads 314, 405 of the UBHO adapter 300 and the snubber housing 402, respectively, are made up until the end face 324 of the UBHO adapter 300 contacts the compression compliance component 412. The threads 314, 405 are further made up to compress the snubbing stack and achieve the desired pre-compression of the compliance components 408, 412. FIG. 7A shows a section of the snubber tool 100 including the rebound compliance component 408 prior to pre-compression. The elastomer rings 430 of the rebound compliance component 408 are in the relaxed state, and the upper end of the rebound compliance component 408 is not engaged with the shelf 403 of the snubber housing 402. FIG. 7B shows the same section of the snubber tool as in FIG. 7A after pre-compression. Due to pre-compression, the upper end of the rebound compliance component 408 has moved down the mule shoe adapter body 204 and is engaged with the snubber housing shelf 430, and the elastomer rings 430 of the rebound compliance component 408 are now bulging. However, there are still voids 500, 502 between the elastomer rings 430 and the adjacent surfaces of the snubber housing 402 and mule shoe adapter body 204, respectively. These voids will be filled when the rebound compliance component 408 is further compressed as a result of tension or bulk loading on the snubber tool. The compression compliance component (412 in FIG. 1A) is pre-compressed in the same manner as the rebound compliance component, with voids around the elastomer rings that are filled during bulk loading of the compression compliance component.

Returning to FIG. 1A, in some examples, a minimum combined pre-compression of 0.2 inches is applied to the rebound compliance component 408 and compression compliance component 412. In general, the axial stiffness of the snubber tool 100 will increase as pre-compression increases. The pre-compression will be divided between the rebound compliance component 408 and compression compliance component 412, with the rebound compliance component 408 taking up a majority of the pre-compression. For example, the rebound compliance component 408 may take up 90% or more of the pre-compression in some cases, with the remaining pre-compression going to the compression compliance component 412. Pre-compression will ensure that when load is transferred to the snubber tool 100, there is no gap between the elastomer rings of the compliance components 408, 412 and the shelf 403 of the housing unit and the end face 234 of the UBHO adapter 300. This will have the effect of providing better fatigue life for the elastomer and damping under both rebound and compression loads.

Figure 8:
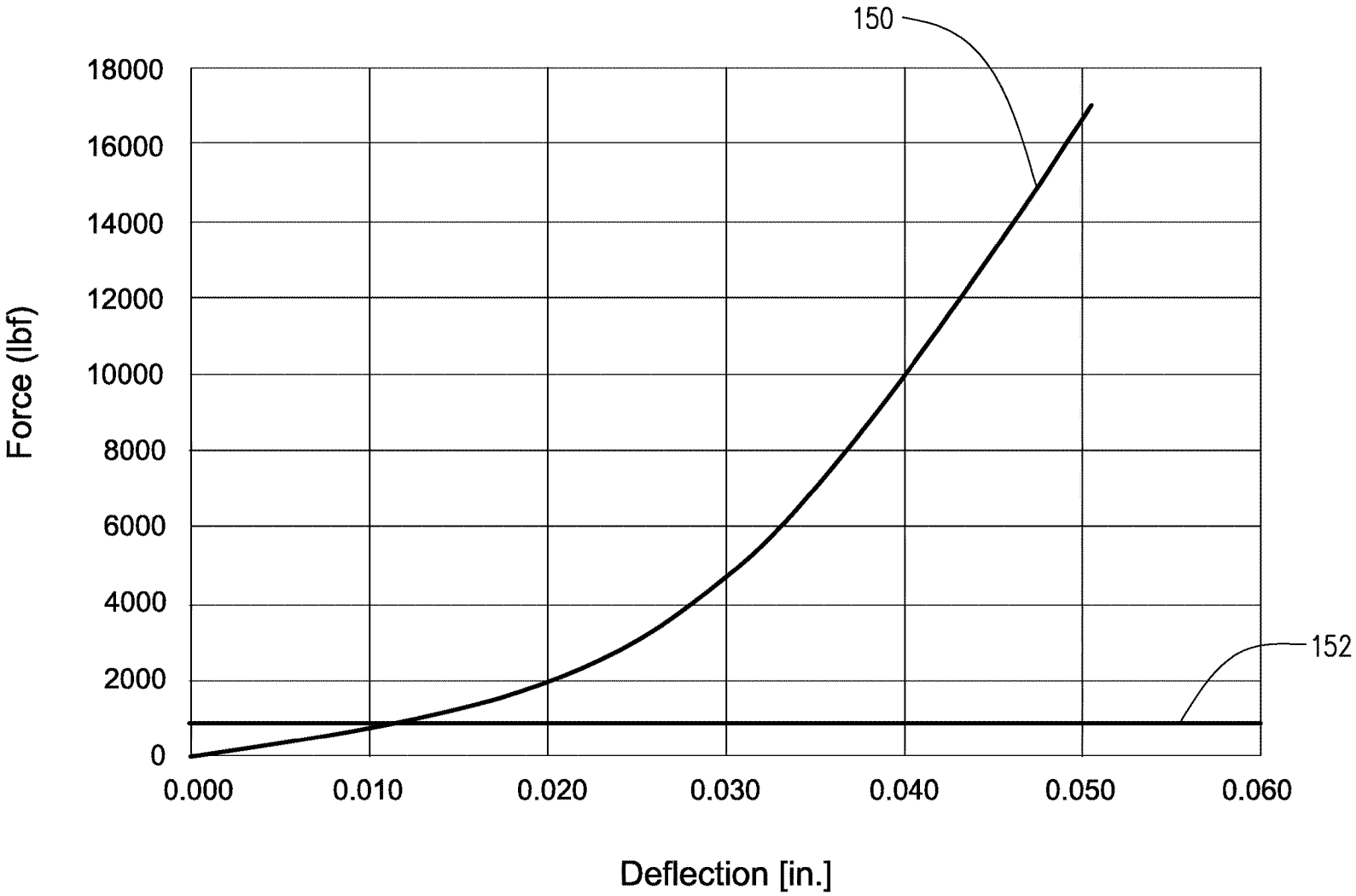
FIG. 8 is a plot of a load deflection curve for an example configuration of the snubber tool of FIG. 1A.

In some embodiments, a shock absorber configured to an axial stiffness of 80,000 lb/in at 850 lbf includes a rebound compliance component 408 having two rebound compliance elements and a compression compliance component 412 having three rebound compliance elements. Each rebound compliance element comprises an elastomer ring having an axial thickness of 0.36 in +/−0.004 in. Each compression compliance element comprises an elastomer ring having an axial thickness of 0.08 in +/−0.004 in. The snubber tool 100 is pre-compressed to about 0.2 inches. This means that the rebound compliance component and compression compliance component are pre-compressed to about 0.2 inches, with the rebound compliance component 408 taking a majority of the pre-compression, e.g., about 0.195 inches, and the compression compliance component taking the remainder of the pre-compression, e.g., about 0.005 inches. In general, the snubber tool 100 may be pre-compressed to a minimum of 0.2 inches, with the rebound compliance component 408 taking a majority of the pre-compression. For the configuration where the snubber tool 100 is pre-compressed to 0.2 inches, soft snubbing (i.e., non-linear viscoelastic behavior of elastomer) begins to occur at 0.02 inches of deflection, and bulk loading occurs between 0.05 inches and 0.1 inches. Bulk loading is when the elastomer rings fill the adjacent voids in the annular space between the mule shoe adapter and the snubber housing. FIG. 8 shows a load deflection curve 150 of the snubber tool 100 configured as above, i.e., with the pre-compression of 0.2 inches. The horizontal line 152 indicates 850 lbf, which is the load at which the stiffness is measured. 0 inches to 0.02 inches is the linear range of the snubber tool stiffness. 0.02 inches to 0.05 inches is the "soft snubbing" range of the snubber tool. 0.05 inches and beyond is the "bulk loading" range of the snubber tool. Due to the thicknesses of the compliance components 408, 412 and the deflection required to put the snubber tool into bulk loading, the snubber tool will not ever lose its initial pre-compression. Therefore, once the snubber tool takes on set due to higher temperature, e.g., 300° F. to 350° F., and loading over a prolonged period of time in operation, the snubber tool will go into a bulk loading state and not lose pre-compression. In general, the thicknesses and pre-compression of the compliance components 408, 412 are selected such that the compliance components 408, 412 will not lose pre-compression when the snubber tool goes into a bulk loading state.

Figure 9:
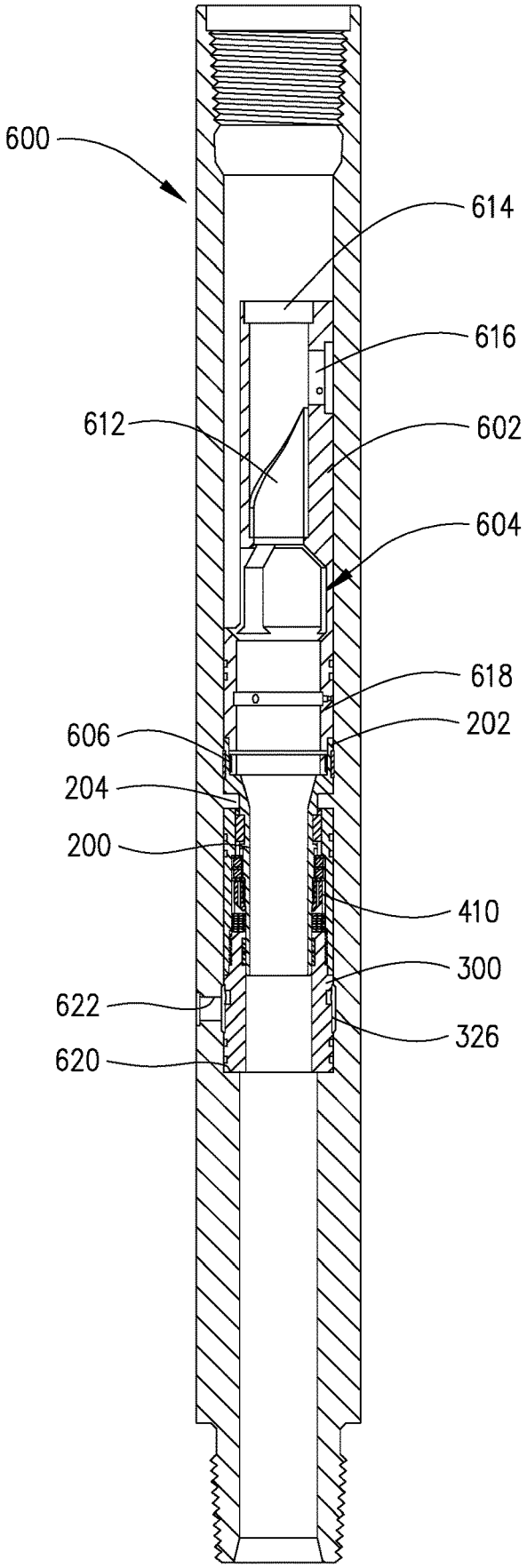
FIG. 9 is a cross-sectional view of a snubber tool disposed inside a UBHO sub and assembled to a mule shoe.

FIG. 9 shows a cross-sectional view of a UBHO sub 600 having a mule shoe 602. The mule shoe 602 is a hollow cylindrical inner member of the UBHO sub 600 and may also be referred to as a landing sleeve. A directional measurement tool 604 is locked into the mule shoe 602. The directional measurement tool 604 may include a pulser helix interface 612, a wear cuff 614, an alignment key 616, and a bottom sleeve 618. Although not shown, the bottom sleeve 618 may contain sensitive components that need to be isolated from vibrations over a selected frequency. Moreover, other components can be coupled to the directional measurement tool 604 and UBHO sub 600 that need to be isolated from vibrations over a selected frequency. The snubber tool 100 is disposed within the UBHO sub 600. In some cases, the UBHO sub 600 may include a seat 620 on which the UBHO adapter 300 of the snubber tool 100 is mounted. The UBHO adapter 300 may then be secured to the body of the UBHO sub 600 by inserting set screws (not shown) into holes 622 in the UBHO sub 600. The holes 622 may be distributed about a circumference of the UBHO sub 600. The set screws will extend to a circumferential recessed surface 326 (also, see FIG. 3) on the UBHO adapter 300 and engage the UBHO adapter 300. Other methods of securing the UBHO adapter 300 to the UBHO sub may be used besides the one described above. The mule shoe adapter head 202 of the snubber tool 100 may be coupled to the bottom sleeve 618, for example, by making up a threaded connection 606 between the mule shoe adapter head 202 and the bottom sleeve 618.

In operation, the snubber tool 100 may receive disturbing axial input forces (e.g., compressive forces and/or tensile forces) from the mule shoe 602. The forces may be transferred to the mule shoe adapter 200 and then to the drive washer 410. Referring to FIG. 1A, in response, the drive washer 410 will move axially within the annular space 406 and thereby further compress the rebound compliance component 408 or the compression compliance component 412. Under compression loading of the snubber tool 100, the drive washer 410 will further compress the compression compliance component 412, causing compression to be relieved from the rebound compliance component 408. Under tension loading of the snubber tool 100, the drive washer 410 will further compress the rebound compliance component 408, causing compression to be relieved from the compression compliance component 412. It should be noted that the rebound compliance component 408 and the compression compliance component 412 always remain under pre-compression, i.e., regardless of whether the snubber tool 100 is in overall compression or tension. In general, the drive washer 410 will act as a piston within the annular space 406, moving against the rebound compliance component 408 or the compression compliance component 412 in response to external loading on the snubber tool 100. The elastomer rings of the compliance components 408, 412 are set up to bulge, i.e., radially expand, to fill the entire "free volume" between the outer diameter of the elastomer rings and the inside diameter of the snubber housing 402/outer diameter of the mule shoe adapter body 204. If a shock/vibration event is large enough for this to occur, then the snubber tool 100 will go into "bulk loading". Soft snubbing (i.e., non-linear viscoelastic behavior of elastomer) will also occur, as shown, for example, in FIG. 8. Damping is enhanced during soft snubbing.

The design of the snubber tool 100 is such that it can be used in UBHO subs of various sizes without changing the internal structure of the tool. Typically, the only changes required when adapting the snubber tool for a different size of UBHO are adjustments in the wall thickness of the snubber housing 402, the wall thickness of the lower body section 304 of the UBHO adapter 300, and the wall thickness of the mule shoe adapter head 202.

After a run of the snubber tool 100 downhole, the replaceable components of the snubber tool 100 will be the rebound compliance component 408, compression compliance component 412, anti-rotation pins 227, wear bands 214, 312, and O-rings 318. All major metal components of the snubber tool 100 will be reusable, making the snubber tool 100 a cost-effective tool for downhole use.

While the invention has been described with respect to a limited number of embodiments, those skilled in the art of, having benefit of this disclosure, will appreciate that other embodiments can be devised which do not depart from the scope of the invention as disclosed herein. Accordingly, the scope of the invention should be limited only by the accompanying claims.

The invention claimed is:

1. A snubber tool for a downhole tool string, comprising:

a mule shoe adapter;

a universal bottom hole orientation (UBHO) adapter;

a rebound compliance component having a first stiffness and a first pre-compression, the rebound compliance component being configured to retain at least a portion of the first pre-compression under external loading of the snubber tool;

a compression compliance component having a second stiffness larger than the first stiffness and a second pre-compression smaller than the first pre-compression, the compression compliance component being configured to retain at least a portion of the second pre-compression under external loading of the snubber tool; and a drive washer arranged between and in contact with the rebound compliance component and the compression compliance component and coupled to the mule shoe adapter, the drive washer being configured to selectively apply a further compression to the rebound compliance component and compression compliance component in response to an external force acting on the mule shoe adapter.

2. The snubber tool of claim 1, wherein the rebound compliance component and the compression compliance component are configured to retain the first pre-compression and second pre-compression, respectively, under bulk loading of the snubber tool.

3. The snubber tool of claim 1, wherein the mule shoe adapter comprises an inner threaded surface that is adapted for engaging an outer threaded surface of a sleeve of the downhole tool string.

4. The snubber tool of claim 1, further comprising a housing having a bore, wherein the mule shoe adapter has a mute shoe adapter section received within the bore, and wherein the rebound compliance component, the compression compliance component, and the drive washer are arranged in a stack in an annular space between the mule shoe adapter section and the housing.

5. The snubber tool of claim 4, wherein the UBHO adapter has a UBHO adapter section received within the bore and secured to the housing.

6. The snubber tool of claim 5, wherein the rebound compliance component, the drive washer, and the compression compliance component are compressed between an end face of the UBHO adapter section and a shelf formed on an inner surface of the housing, wherein a distance between the shelf and end face are selected to induce the first pre-compression and the second pre-compression in the rebound compliance component and the compression compliance component, respectively.

7. The snubber tool of claim 6, wherein the UBHO adapter section comprises an outer threaded surface, wherein the housing comprises an inner threaded surface, and wherein the UBHO adapter and housing are configured such that engagement of the outer threaded surface with the inner threaded surface applies the first pre-compression to the rebound compliance component and the second pre-compression to the compression compliance component.

8. The snubber tool of claim 6, wherein an end portion of the mule shoe adapter section is received within a bore of the UBHO adapter such that an outer surface portion of the mule shoe adapter section mates with an inner surface portion of the UBHO adapter section, and further comprising a wear hand disposed between the mating outer surface portion and the inner surface portion.

9. The snubber tool of claim 6, further comprising a plurality of anti-rotation pins inserted between the mule shoe adapter section and the housing for preventing rotation of the mule shoe adapter relative to the housing.

10. The snubber tool of claim 4, wherein the rebound compliance component comprises a first stack of at least two first elastomer rings, and wherein the compression compliance component comprises a second stack of at least two second elastomer rings.

11. The snubber tool of claim 10, wherein a combined axial thickness of the first elastomer rings in the first stack is greater than a combined axial thickness of the second elastomer rings in the second stack.

12. The snubber tool of claim 10, wherein an outer circumferential surface of each of the at least two first elastomer rings has a contoured profile selected to relieve induced strain when the rebound compliance component is further compressed.

13. The snubber tool of claim 10, wherein the first stack further comprises first shims in alternating arrangement with and bonded to the at least two first elastomer rings, and wherein the second stack further comprises second shims in alternating arrangement with and bonded to the at least two second elastomer rings.

14. The snubber tool of claim 10, wherein the first elastomer rings are configured to bulge and fill up a free volume between the rebound compliance component and the housing under bulk loading, and wherein the second elastomer rings are configured to bulge and fill up a free volume between the compression compliance component and the housing under bulk loading.

15. The snubber tool of claim 14, wherein the first elastomer rings are configured to bulge and fill up a free volume between the rebound compliance component and the mule shoe adapter section under bulk loading, and wherein the second elastomer rings are configured to bulge and fill up a free volume between the compression compliance component and the mule shoe adapter section under bulk loading.

16. The snubber tool of claim 1, wherein the drive washer comprises an inner threaded surface, wherein the mule shoe adapter comprises an outer threaded surface, and wherein the drive washer is coupled to the mule shoe adapter by engaging the inner threaded surface with the outer threaded surface.

17. The snubber tool of claim 16, wherein the drive washer comprises an inner tapered surface adjacent to the inner threaded surface, wherein the mule shoe adapter comprises an outer tapered surface adjacent to the outer threaded surface, and wherein the inner tapered surface mates with the outer tapered surface when the inner threaded surface is engaged with the outer threaded surface.

18. The snubber tool of claim 1, which has a select pre-compression under all loading conditions, the select pre-compression being divided between the rebound compliance component and the compression compliance component as the first pre-compression and the second pre-compression, respectively, wherein an initial value of the first pre-compression is at least 90% of the select pre-compression.

19. A downhole tool string, comprising:

a universal bottom hole orientation (UBHO) sub having a mule shoe disposed therein; a snubber tool disposed within the universal bottom hole orientation sub, the snubber tool comprising:

a mule shoe adapter coupled to the mule shoe;

a UBHO adapter mounted to the UBHO sub;

a rebound compliance component having a first stiffness and a first pre-compression, the rebound, compliance component being configured to retain at least a portion of the first pre-compression under external loading of the snubber tool;

a compression compliance component having a second stiffness larger than the first stiffness and a second pre-compression smaller than the first pre-compression, the compression compliance component being configured to retain at least a portion of the second pre-compression under external loading of the snubber tool; and a drive washer arranged between the rebound compliance component and the compression compliance component and coupled to the mule shoe adapter, the drive washer being configured to selectively apply a further compression to the rebound compliance component and compression compliance component in response to an external force acting on the mule shoe adapter.

20. A method of reducing vibration in a downhole tool string having a mule shoe, comprising:

coupling a snubber tool to the mule shoe of the downhole tool string, the snubber tool comprising a rebound compliance component having a first stiffness and a first pre-compression and configured to retain at least portion of the first pre-compression under external loading of the snubber tool, a compression compliance component having a second stiffness larger than the first stiffness and a second pre-compression smaller than the first pre-compression and configured to retain at least a portion of the second pre-compression under external loading of the snubber tool, and a drive washer arranged between and in contact with the rebound compliance component and the compression compliance component;

receiving a force imparted on the mule shoe at a drive washer of the snubber tool; and further compressing one of the rebound compliance component and the compression compliance component of the snubber tool in response to the received force by motion of the drive washer.

* * * * *